United States Patent [19]

Randerson

[11] 3,989,231

[45] Nov. 2, 1976

[54] HEAT TREATMENT OF STEEL

[75] Inventor: Keith Randerson, Middlesbrough, England

[73] Assignee: British Steel Corporation, London, England

[22] Filed: Mar. 10, 1975

[21] Appl. No.: 557,042

Related U.S. Application Data

[62] Division of Ser. No. 339,309, March 8, 1973, Pat. No. 3,928,090.

[30] Foreign Application Priority Data

Mar. 9, 1972 United Kingdom ..... 11087/72

[52] U.S. Cl. ..... 266/114; 134/199

[51] Int. Cl.[2] ..... C21D 1/62; C21D 1/82

[58] Field of Search ..... 148/143; 266/4 S, 6 S, 266/113, 114; 134/64, 122, 199

[56] References Cited

UNITED STATES PATENTS

| | | | |
|---|---|---|---|
| 2,394,514 | 2/1946 | Evans et al. | 134/122 X |
| 3,208,742 | 9/1965 | Peretic | 266/4 S |
| 3,300,198 | 1/1967 | Clumpner et al. | 266/4 S |
| 3,323,577 | 6/1967 | Clumpner | 266/3 R |
| 3,511,250 | 5/1970 | Gallucci et al. | 134/122 |
| 3,554,513 | 1/1971 | Chance | 266/4 S X |
| 3,629,015 | 12/1971 | Yonezawa et al. | 266/6 S X |
| 3,756,869 | 9/1973 | Melloy et al. | 148/143 |
| 3,792,844 | 2/1974 | Berry et al. | 266/6 S |

FOREIGN PATENTS OR APPLICATIONS

| | | | |
|---|---|---|---|
| 1,226,564 | 3/1971 | United Kingdom | 266/6 S X |

*Primary Examiner*—Roy Lake
*Assistant Examiner*—Paul A. Bell
*Attorney, Agent, or Firm*—Bacon & Thomas

[57] ABSTRACT

A steel body at red heat or higher temperature is heat treated by sequentially carrying it through a descaling unit, where scale is removed by water jets at an impact force above 2.5 kg/cm$^2$, and then into an accelerated cooling process such as a quench rig where it is cooled rapidly down through its transformation temperature. If the temperature is below transformation after descaling the steel body is reheated without new scale formation before passing to accelerated cooling. Cooling water and surface quality are thereby improved.

5 Claims, 2 Drawing Figures

HIGH IMPACT PRESSURE DESCALING UNIT
HIGH PRESSURE WATER SOURCE
10
11
12
13
14
15
18
19
20
21
22
25
26
27
29
INTERMEDIATE HEATING FURNACE
ACCELERATED COOLING UNIT

HEAT TREATMENT OF STEEL

This application is a division of copending application Ser. No. 339,309 filed on Mar. 8, 1973, now U.S. Pat. No. 3,928,090.

This invention relates to the heat treatment of steel, and in particular to heat treatment in which steel is cooled from a temperature above the upper change point, as by quenching.

The invention is particularly applicable to the quenching of steel plates. It is generally undesirable that a cooled plate should have a layer of oxide scale on its surface, yet such scale will rapidly form on hot steel in the presence of oxygen, e.g. atmospheric oxygen, and will accordingly form if the plate is heated in air to the temperature from which it is to be quenched. The scale can be removed after the steel has cooled, for example by blasting with sand, grit or shot, but this involves an additional step in the manufacturing process and has other attendant disadvantages.

One solution to the problem is to avoid the formation of scale during the heating period prior to quenching by the use of a controlled atmosphere furnace. An initially scale-free plate is heated in the furnace in an atmosphere which is substantially free of oxygen, and the hot plate is transferred to the quench rig and cooled sufficiently rapidly to avoid any substantial scale formation. However, such a furnace can be expensive to install and maintain and this process also requires the removal of surface scale prior to introducing the plates into the furnace.

An alternative approach is to heat the plate in air to the temperature from which it is to be quenched, allowing scale formation, and then to allow a combination of thermal shock from the quenching fluid and mechanical shock from the surfaces of the quench rig to achieve a degree of descaling in the quench rig itself. This may take place in, for example, a roller quench press where the quenching water and the action of the rollers combine to remove at least part of the scale, if this is not unduly adherent. One disadvantage of this procedure is that the scale may not be completely removed in all cases and this could give rise to lower and less uniform cooling rates together with an undesirable surface quality in the quenched plate. In some types of steel the scale may even be sufficiently adherent to prevent substantial removal by this treatment.

In accordance with the present invention there is provided a method of heat treating a steel body having surface scale in which a stream of water at an impact force of at least 2.5 kg/cm$^2$ is applied over the surface scale of the body at red heat or a higher temperature to remove the scale and the body is subsequently subjected to an accelerated cooling process from a temperature above its change point to a lower temperature through transformation.

The invention further provides apparatus for heat treating a steel body having surface scale, which apparatus comprises means for positioning the body, at red heat or a higher temperature, with respect to water supply means such that a stream of water from the supply means can be applied over the surface scale of the body at an impact force of at least 2.5 kg/cm$^2$ to remove the scale, and means for subsequently subjecting the body to an accelerated cooling process from a temperature above its change point to a lower temperature through transformation.

We have found that in the practice of the present invention the removal of surface scale prior to the accelerated cooling of the steel body can enable substantially higher cooling rates to be achieved in the accelerated cooling stage.

When carrying out the descaling step in the practice of the invention the steel body must be at an elevated temperature equivalent to red heat or higher. The minimum temperature may be about 800° C. Since the ease of descaling generally increases with increasing temperature, a more preferable minimum is about 900° C. However, it is preferred that the initial temperature is above the upper change point of the steel, otherwise a reheating step will be necessary before accelerated cooling through transformation. The actual temperature drop during the descaling operation will depend inter alia on the thickness of the steel body and the duration of the descaling period.

The body will normally be subjected to accelerated cooling from above its change point sufficiently soon after descaling to avoid substantial growth of new scale, and the operations of descaling and cooling are suitably carried out sequentially. It is possible to carry out the invention allowing the regions near the surface of the body to be cooled down substantially and the first stages of transformation to occur while descaling the body, and allowing transformation to complete after descaling, provided that accelerated cooling beyond that accomplished during descaling is applied within a short space of time and cooling is continuous through transformation. Thus if a body is passed directly from being descaled, which operation has commenced at a temperature above the change point to further accelerated cooling until transformation is substantially complete, the transformation may be allowed to start during descaling.

If after descaling the body as a whole has a temperature below the change point, an intermediate heating step will be required after descaling and before the body can be cooled from above the change point. Such heating should be carried out rapidly and in a manner which will minimise scale formation, for example in a reducing flame, by infra-red radiation or even in a controlled atmosphere furnace. Such heating may also be necessary in the case where temperature equalisation is allowed to take place after descaling the body to ensure that the whole of the body is above the upper change point before being subjected to accelerated cooling.

The invention is particularly suitable for steel plates, but is also applicable to other steel bodies, for example rolled sections. However, the more complex the shape of the body the more complex will be the arrangement of the high pressure water stream or streams to descale the whole of its surface.

After descaling the accelerated cooling takes place from a temperature above the upper change point ($Ar_3$). Preferably cooling takes place from up to 50° C. above the change point; the upper limit is determined by the usual metallurgical considerations. The cooling process will usually be a quenching process and carried out using water, but other quenching media, for example oil, oil/water or brine, could be used. Other accelerated cooling processes may be used in the method of the invention and include for example lead bath or air patenting of steel rod or wire. The heat treatment operation may extend beyond accelerated cooling and include for example tempering; thus a quenched plate may subsequently be reheated to a tempering temperature and air cooled.

The invention is not only applicable immediately after a reheating operation, but can for example be applied to a steel body immediately after rolling provided that its temperature is high enough.

The descaling operation uses a stream or streams of water at an impact force of at least 2.5 kg/cm², which must be distinguished from the much lower impact forces encountered in a conventional spray quench rig. In the performance of the invention the impact force will generally be from 3 to 5 or 6 kg/cm², the higher figures being particularly applicable for steels having tenacious scale such as some silicon killed steels. It is to be understood that the figures quoted for impact force represent the average force per unit area over the instantaneous area of impact of the stream of water on the steel body.

The descaling water is provided from a nozzle or preferably a plurality of nozzles connected to a high pressure water source and directed at the body. The nozzles and the body may be in fixed positions. Alternatively, a set of nozzles may be arranged across the width of the steel body, the spacing of the nozzles and shape and intensity characteristics of the stream from each nozzle being chosen to give a uniform supply of water across the surface of the body, and in order to apply water over the length of the body, either the set of nozzles may be moved from one end of the body to the other or, preferably, the body is moved lengthwise past the nozzles; however, it should be noted that a body of particularly irregular shape might not be suited to this procedure. In the case of a flat body, such as a plate, it may be particularly convenient to have one set of nozzles in a line across and above the body and a second set of nozzles in a line across and below the body and to pass the plate between the two sets. The body may be carried past the nozzles on rollers or securely clamped to a travelling carriage.

When descaling is to be effected with relative movement between the body and nozzles by moving the one across the other, it is advantageous to ensure that the speed of movement and the water delivery rate are correlated to give a water supply rate of at least 2 gm on every square centimeter of surface to be descaled.

The impact force of the water stream on the body is affected by the pressure in the water supply to the nozzle, the nozzle size, the angle at which the nozzle is set relative to the surface of the body and the distance between the nozzle and body.

The invention will be more completely understood by reference to the drawings, in which.

Figure 1:
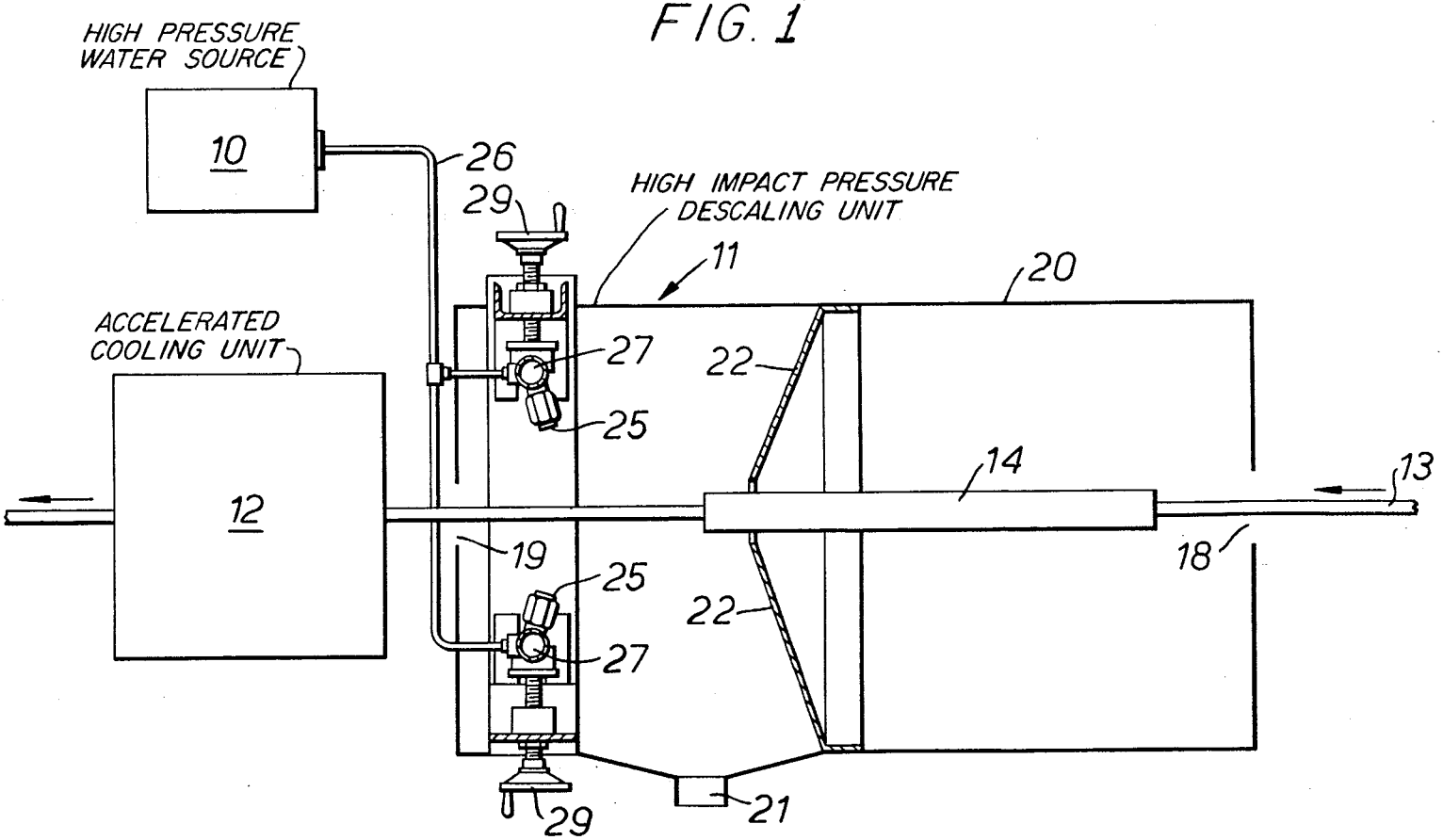
FIG. 1 is a schematic representation of one embodiment of the invention.

Four major components are a source of high pressure water 10, a high pressure descaling unit shown generally at 11, a spray quench unit 12 and a set of rails 13 running through the descaling unit and the spray quench unit. The rails 13 support a carriage 14 on which a steel plate to be treated can be firmly supported while exposing its upper and lower surfaces.

The descaling unit 11 has an inlet 18 and an outlet 19 for the carriage. It is surrounded by a box 20 to contain the spray and as a safety measure. A drain 21 allows water and scale to flow out of the box. Baffles 22 prevent the steel plate from being cooled by low pressure deflected spray before it reaches the high pressure spray region.

The high pressure spray is provided by nozzles 25 supplied from the source of high pressure water 10 by flexible hoses 26 and pipes 27. The nozzles are arranged in upper and lower sets directed at the upper and lower surfaces of the plate. Each set of nozzles is independently adjustable for distance from the plate by adjusting screws 29.

Figure 2:
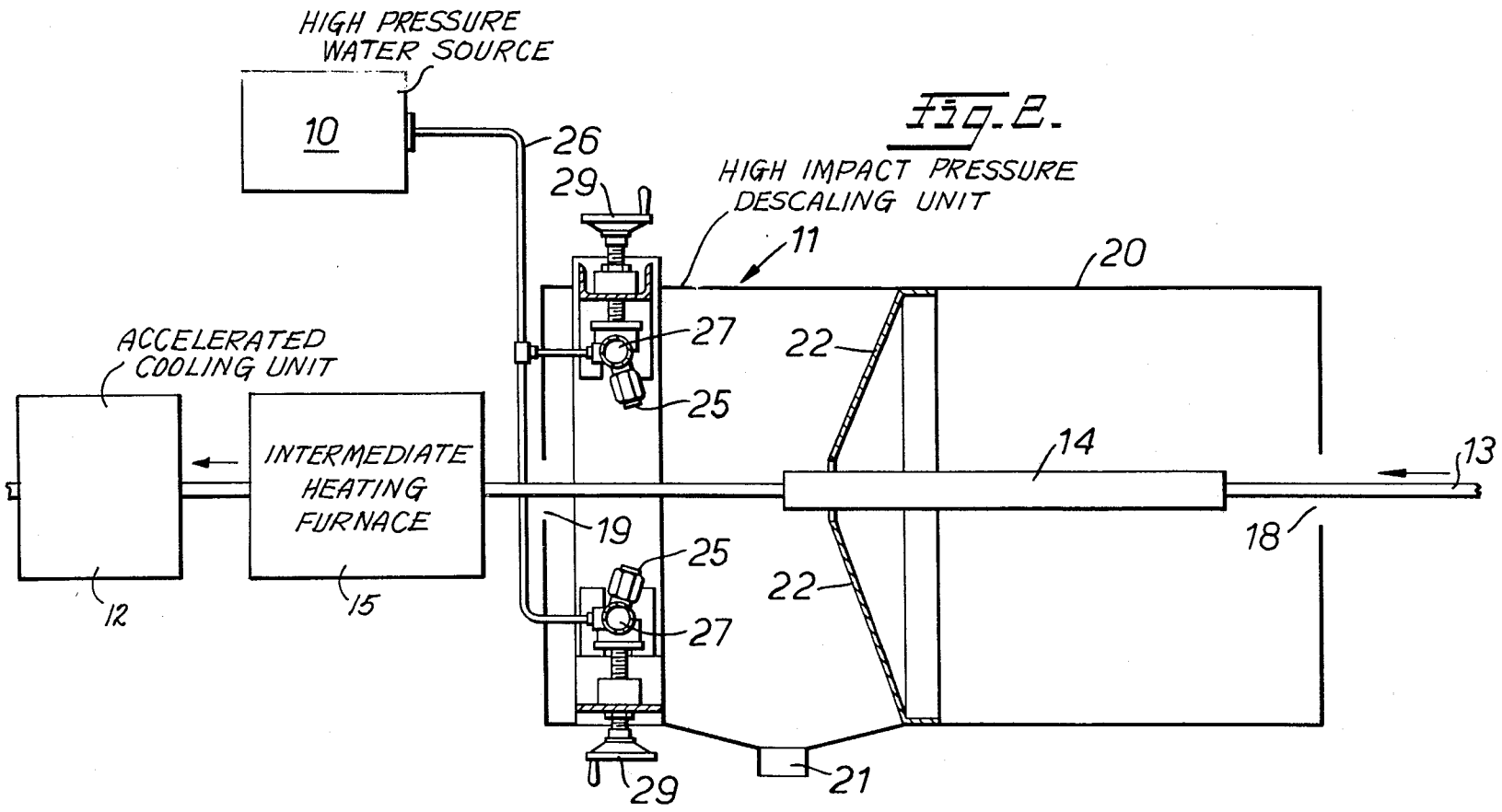
FIG. 2 is a schematic representation similar to FIG. 1 but showing a reheating unit between the descaling unit and accelerated cooling unit.

The spray quench unit 12 is entirely conventional and may comprise means for holding the plate firmly across its length and width to resist buckling, and means for spraying both sides of the plate with water to cool it below its transition temperature. A suitable unit is a roller quenching press in which the means for holding the plate are a sequence of opposed pairs of hollow rollers extending across the width of the plate, between which the plate passes while being sprayed with water in the intervals between successive pairs of rollers. Between it and the descaling unit a suitable reheating unit 15, as described above and illustrated in FIG. 2, can be interposed if desired.

Further details of the nozzle arrangement and water supply rates are given in the following illustrative examples in which 10 inches × 7 inches steel plates of thicknesses of approximately 1½ inches, 1 inch and ½ inch were descaled and quenched. In each case the plate was held in a reheating furnace at 900° C. for one hour, removed from the furnace and after a delay of 20 to 30 seconds passed at a speed of 60 ft/min through a descaling unit and a spray quench rig. During descaling and quenching the temperature at the centre of each plate was monitored by an implanted thermocouple.

The de-scaling unit comprised three nozzles in line across the width of the plate both above and below the plate. Each nozzle gave a flat spray jet with a 26° included angle from a 2.0mm equivalent diameter hole. The nozzles were mounted at 140mm from the plate surfaces at 15° to the vertical pointing towards the plate as it enters the sprays, and the line of the flat spray on the plate was arranged to be at 15° to the line of the plate width.

The nozzles were connected to a water supply at a nominal pressure of about 2500 p.s.i. giving an impact force on the plate of about 5 kg/cm² and a water consumption on the plate surfaces of about 2.2 gm/cm². The nominal supply pressure of about 2500 p.s.i. was closer to 2200 p.s.i. at the nozzles, which may be compared with the typical supply pressure of 120 p.s.i. in the first zone of a conventional roller quench.

Table 1 shows the analysis of the plates created. The plates referred to as ½ inch thick had actual thicknesses between 0.466 and 0.49 inch; the 1 inch plates were between 0.946 and 0.971 inch thick; and the 1½ inch plates were between 1.41 and 1.46 inches thick.

TABLE I

PLATE ANALYSIS

| Thickness | C % | Si % | S % | P % | Mn % | Ni % | Cr % | Mo % | Cu % | Sn % | V % | Al Tot. | Al Sol. |
|---|---|---|---|---|---|---|---|---|---|---|---|---|---|
| ½" | .215 | .25 | .017 | .014 | 1.56 | .06 | .043 | .03 | .11 | .044 | <.01 | .003 | .001 |

TABLE I-continued

| PLATE ANALYSIS | | | | | | | | | | | | | |
|---|---|---|---|---|---|---|---|---|---|---|---|---|---|
| Thickness | C % | Si % | S % | P % | Mn % | Ni % | Cr % | Mo % | Cu % | Sn % | V % | Al Tot. | Al Sol. |
| 1" | .18 | .25 | .013 | .013 | 1.55 | .04 | .045 | .035 | .06 | .011 | <.01 | .014 | .008 |
| 1½" | .195 | .25 | .013 | .014 | 1.55 | .06 | .045 | .03 | .08 | .011 | <.01 | .010 | .010 |

Complete scale removal was achieved in the descaling unit. During descaling there was no detectable temperature drop at the centre of a 1 inch plate, while in a ½ inch plate a temperature drop of 50°–100° C. was observed. This was not a sufficient drop to initiate transformation in the descaling unit.

Five plates of ½ inch and 1½ inches and eight of 1 inch thickness were descaled and spray quenched as described above; the average cooling rates between 700° C and 300° C in the quench rig were as shown in Table II. This table also shows for comparison the cooling rates between the same temperatures and in the same quench rig of ½ inch and 1 inch plates which were not descaled prior to quenching.

TABLE II

| Plate Thickness | Cooling Rate ° C/sec. (descaled) Range | Ave. | Cooling Rate (not descaled) ° C/sec. Range | Ave. |
|---|---|---|---|---|
| ½" | 103–123 | 114 | 28.00–50.5 | 34.1 |
| 1" | 34.0–38.1 | 35.1 | 16.1–22.1 | 19.8 |
| 1½" | 16.7–18.2 | 17.3 | — | — |

The descaled and quenched plates had good surface qualities, illustrating the attainment of clean surfaces together with good quench rates. It can be seen that the invention enables effective removal of scale to be achieved and increases the rate of heat transfer between the plate and the quenching medium thus increasing the quenching rate. The plates were suitable for subsequent tempering, coating or forming operations as required.

We claim:

1. Apparatus for improving the cooling rate of a hot steel body having surface scale and subjected to accelerated cooling from a temperature above its change point to a lower temperature through transformation, comprising: in combination, means for subjecting said body to said accelerated cooling; a descaling unit substantially immediately ahead of said accelerated cooling means for descaling without reducing the temperature of the entire body below transition temperature; high pressure water supply means; nozzle means in said descaling unit connected to said high pressure water supply means; means for effecting relative movement between said steel body, at a temperature of at least red heat, and said nozzle means and for subsequently moving said body while still hot into said accelerated cooling means before substantial growth of new scale can occur; the high pressure water supply means, nozzle openings and angle of set of the nozzle means relative to the surface of the hot steel body and distance between the nozzle means and the body being correlated to provide a descaling impact pressure of at least 2.5 kg/cm$^2$ at the surface of said body, to thereby effectively remove scale from the surface of said body and increase the rate of heat transfer in the accelerated cooling unit.

2. Apparatus as claimed in claim 1 wherein the means for effecting relative movement between said body and nozzle means comprises a carriage which is adapted to carry the body and is movable past the nozzle means.

3. Apparatus as claimed in claim 2 wherein said nozzle means comprises a plurality of jet nozzles which are inclined toward the surface of the body to provide a flat jet spray pattern across the surface of the body opposed to the direction of travel of the body.

4. Apparatus as claimed in claim 1 wherein the means for subjecting the body to accelerated cooling comprises a spray quench unit.

5. Apparatus as claimed in claim 1 including means between the descaling unit and accelerated cooling means for reheating the body to a temperature above its change point after removal of the scale and before the body is subjected to the accelerated cooling process.

* * * * *